US010532559B2

(12) United States Patent
Quintero Ruiz et al.

(10) Patent No.: US 10,532,559 B2
(45) **Date of Patent: *Jan. 14, 2020**

(54) PRINTER AND COMPUTER-IMPLEMENTED PROCESS FOR CONTROLLING A PRINTER

(71) Applicant: HEWLETT-PACKARD DEVELOPMENT COMPANY, L.P., Houston, TX (US)

(72) Inventors: Xavier Quintero Ruiz, Sant Cugat del Valles (ES); Roma Segura Fabregas, Barcelona (ES); Marcos Casaldaliga, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/989,458

(22) Filed: May 25, 2018

(65) Prior Publication Data

US 2018/0272695 A1 Sep. 27, 2018

Related U.S. Application Data

(63) Continuation of application No. 15/544,374, filed as application No. PCT/EP2015/053108 on Feb. 13, 2015, now Pat. No. 10,011,108.

(51) Int. Cl.
*B41J 2/045* (2006.01)
*B41J 2/155* (2006.01)
(Continued)

(52) U.S. Cl.
CPC ..... *B41J 2/04505* (2013.01); *B41J 2/04558* (2013.01); *B41J 2/155* (2013.01);
(Continued)

(58) Field of Classification Search
CPC . B41J 2/155; B41J 2029/3935; B41J 2202/20
See application file for complete search history.

(56) References Cited

U.S. PATENT DOCUMENTS 6,196,652 B1 3/2001 Subirada et al.
6,347,856 B1 2/2002 Arquilevich et al.
(Continued)

FOREIGN PATENT DOCUMENTS

EP 1245398 10/2002
EP 1764996 3/2007
(Continued)

OTHER PUBLICATIONS

HP Business Inkjet 3000. 3000n . 3000dtn : Service and Support Manual; Nov. 13, 2002; http://www.tonerinkprint.com/hp_business_inkjet_3000_series_service_manual.pdf (416 pages).

*Primary Examiner* — Julian D Huffman
(74) *Attorney, Agent, or Firm* — HP Inc. Patent Department

(57) ABSTRACT

In some examples, a printer includes neighboring nozzle arrays extending across a print zone, each nozzle array of the neighboring nozzle arrays extending along an axis and comprising a first section of nozzles and a second section of nozzles, wherein the second sections of the neighboring nozzle arrays overlap defining an overlap region and the first sections of the neighboring nozzle arrays define non-overlap regions. A controller is to cause printing of a test pattern using the neighboring nozzle arrays, the test pattern comprising a first pattern printed by the second sections of the neighboring nozzle arrays in the overlap region, and a reference pattern printed by a first section of the first sections of the neighboring nozzle arrays in a non-overlap region of the non-overlap regions, receive detected characteristics of the printed test pattern, compare the characteristics of the printed test pattern in the overlap region and in the non-overlap region, and derive alignment information based on the comparing.

19 Claims, 9 Drawing Sheets

(51) Int. Cl.
*B41J 2/21* (2006.01)
*B41J 29/393* (2006.01)

(52) U.S. Cl.
CPC ..... *B41J 2/2135* (2013.01); *B41J 2/2146* (2013.01); *B41J 29/393* (2013.01); *B41J 2029/3935* (2013.01); *B41J 2202/20* (2013.01)

(56) References Cited

U.S. PATENT DOCUMENTS

| | | | |
|---|---|---|---|
| 6,394,579 | B1 | 5/2002 | Boyd et al. |
| 6,886,905 | B2 | 5/2005 | McElfresh et al. |
| 6,940,618 | B2 | 9/2005 | Kinas |
| 6,966,712 | B2 | 11/2005 | Trelewicz et al. |
| 6,981,756 | B2 | 1/2006 | Fredrickson et al. |
| 7,036,904 | B2 | 5/2006 | King et al. |
| 8,662,625 | B2 | 3/2014 | Donaldson |
| 2003/0001914 | A1 | 1/2003 | Matsumoto et al. |
| 2008/0284804 | A1 | 11/2008 | Seccombe |
| 2010/0156980 | A1 | 6/2010 | Azuma |
| 2012/0212532 | A1 | 8/2012 | Seccombe |
| 2014/0015887 | A1 | 1/2014 | Seccombe |

FOREIGN PATENT DOCUMENTS

| | | |
|---|---|---|
| JP | 5322436 | 10/2013 |
| WO | WO-2006017800 | 2/2006 |

PRINTER AND COMPUTER-IMPLEMENTED PROCESS FOR CONTROLLING A PRINTER

CROSS REFERENCE TO RELATED APPLICATIONS

This is a continuation of U.S. application Ser. No. 15/544,374, having a national entry date of Jul. 18, 2017, which is a national stage application under 35 U.S.C. § 371 of PCT/EP2015/053108, filed Feb. 13, 2015, which are both hereby incorporated by reference in their entirety.

FIELD

Some printing devices having a carriage moving in a scanning direction may provide an efficient way of printing but can reach a limit in terms of throughput improvement because the carriage may need to cross a print medium for each scan. Another type of printers, called a page-wide array printer, may comprise a bar of print heads spanning across the entire print zone and hence across an entire print medium. A page-wide array printer may allow printing a whole page in a continuous print media movement. A page-wide array printer may allow high printing speed. It may comprise a number of print heads which are arranged along a print head axis adjacent to each other and, as a set, extend across the entire print zone. Each print head may carry dies, each die providing a nozzle array. In order to avoid gaps between print heads during printing, e.g. due to the mechanical tolerances in the zones between the print heads, there may be an overlap between the nozzle arrays of adjacent print heads and between the nozzle arrays of adjacent dies to provide nozzle redundancy and to be able to compensate for any possible printing offset. Part of the image printed by the overlapping nozzles may be referred to as an overlap zone, and the remainder of the image, not printed by overlapping nozzle arrays, may be called a non-overlap zone.

Examples of this disclosure are described with reference to the drawings which are provided for illustrative purposes, in which:

DESCRIPTION OF EXAMPLES

Figure 1:
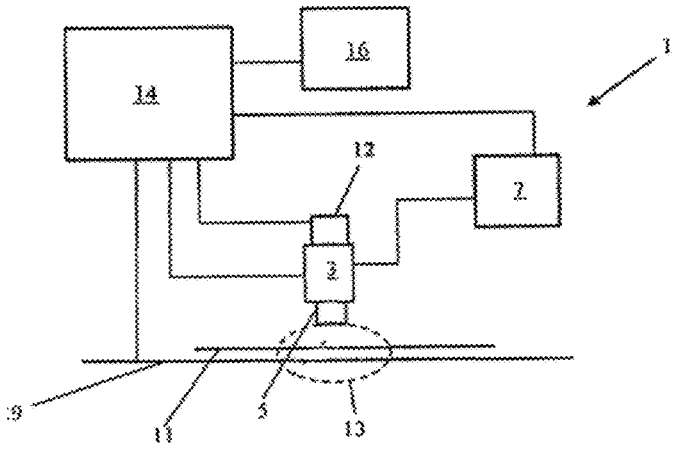
FIG. 1 shows a schematic drawing of a page-wide array printer according to one example.

According to one example, this disclosure provides a printer for printing on a print medium as said print medium advances through a print zone. The printer may be a page-wide array printer or a scanning printer. The page-wide array printer may include a number of print heads, the print heads carrying dies for providing arrays of nozzles which, in combination, extend across an entire print zone. Such an arrangement allows the entire width of a print medium to be printed simultaneously. Print media may be of any sort of sheet-like medium, including paper, cardboard, plastic, and textile.

Due to the relative length of the print heads, when compared to their widths, the set of print heads of a page-wide array printer also are called a print bar. The print bar may be mounted fixedly relative to the printer, and the print medium on which an image is to be printed is moved perpendicularly to the print bar through a print zone along a print media transport path. A complete image can be printed in a continuous movement of the print medium past the print bar or in multiple passes.

In some examples, page-wide array printers may be sensitive to local discontinuities in their nozzle arrays arranged in said print bar, e.g. when neighboring nozzle arrays are not perfectly aligned to each other. As printing is done in one pass (compared to several passes in the scanning printer case), it may be more difficult to hide any defects caused by the variability of the printer itself. For example, the position of the print heads within the printer and the position of the print head dies or nozzle arrays relative to each other may have a variability of +/−100 μm. In order to avoid gaps between print head dies due to the mechanical variability in the zones between the print head dies, there may be an overlap of adjacent nozzle arrays to provide nozzle redundancy and to be able to compensate for errors. The part of an image printed by these overlapping nozzles may be referred to as an overlap zone. Print head alignment calibration may help to reduce the effect of print head position tolerances, based on a determination of alignment errors.

When printing with a scanning printer, a carriage may carry multiple print heads across the print zone wherein, in a scanning printer, the media moves in the direction in which the print heads extend, and the carriage moves orthogonally thereto. In a scanning printer, there may be staggered print heads with an overlap area of print heads or nozzle arrays to provide for some nozzle redundancy. When using a scanning printer in a single-pass or low-pass print-mode for fast printing, multi-pass redundancy cannot be used and different approaches need to be taken to hide defects in the zone of overlap or die stitching zone. Also in this case, based on a determination of alignment errors between nozzle arrays of one print head, or between nozzle arrays of several print heads, print head alignment calibration can be achieved.

Alignment errors of print head dies may be determined by printing test patterns which then are scanned and evaluated.

Determining misalignments in the print head axis direction and perpendicularly thereto is used to calibrate the print heads and possibly also the media advance system. Alignment patterns would be expected to be scanned by a scanning device which may precisely scan the pattern in the desired positions or, if the scanning device has a lower degree of preciseness, provides a number of scans to derive reliable position information from the alignment patterns. A page-wide array printer may not have a precisely mechanized carriage which would allow mounting the scanning device thereto because no print head carriage is needed in a page-wide array printer. The scanning device hence may be mounted to its own carriage for scanning an alignment pattern and deriving alignment information therefrom.

In one example of this disclosure, a method of controlling a printer is proposed, the printer including a number of print heads extending across a print zone wherein each print head includes nozzle arrays extending in a direction of a print head axis. Each nozzle array may comprise a center section of nozzles and two side sections of nozzles wherein the side sections of neighboring nozzle arrays overlap defining an overlap region and wherein the center sections of the nozzle arrays define non-overlap regions. For deriving alignment information useful for print head alignment calibration, the printer may print a test pattern using at least two of said nozzles array, the test pattern comprising an interferential-type pattern printed by the side sections of the nozzle arrays in the overlap region and a reference pattern printed by the center sections of the nozzle arrays in the non-overlap regions. The printed test pattern is scanned and then characteristics of the test pattern in the overlap region and characteristics of the test pattern in the non-overlap regions are compared. Information concerning the alignment of the nozzle arrays can be derived from this comparison. The method may, for example, mix the concept of block-type alignment patterns and interferential-type alignment patterns in order to benefit from the best of both. A central part of a die or nozzle array (the one without overlap of adjacent dies) can be used to print reference blocks while the overlapping zones can be used to print interferential blocks. The interferential blocks can be used to create images which, when printed by neighboring dies in the overlapping zones, will have a varying pattern, or more generally a varying appearance, depending on the offset between the dies. Reference blocks are printed by the central non-overlapping part of the dies and can be used for different purposes. They can be used for simulating different alignment states corresponding to different images printed based on the interferential blocks in the overlapping zone; and they can be used for determining the distance between neighboring dies, for example.

In general, the alignment with block-type patterns work by detecting "where" a pattern is and to correlate this information with where the pattern should be. Alignment based on interferential-type patterns works by analyzing various subsets of patterns that are printed and may change some property depending on whether adjacent dies that print in an overlap zone are aligned or not. Based on this information, correction values which would yield the correct alignment of the patterns can be calculated.

In case of page-wide array printers, the block-type patterns may have the feature of not needing many scans in order to get the desired information; for some properties, such as the distance of the dies in the print head axis direction, or pen axis direction, just one scan may be enough. However, for measuring the alignment in cross-pen axis direction, simple block-type patterns may not be precise nor robust against trajectory errors of the scanning device, media misplacements and the like. The print head axis direction is the direction in which the nozzle array of a die extends. In a page-wide array printer, the print head axis direction is perpendicular to the print media direction. A skewed scan can cause an erroneous detection of a scanned position of a block which would lead to a miscalculation as to the block's position, which is particularly noticeable in a direction perpendicular to the print head axis.

Interferential-type patterns may be very robust and precise but may need a larger number of scans in order to receive the desired information. The increase in patterns to print and scan may result in the expense of time, print media and resources.

The approach described herein mixes the two concepts. In one example, the reference pattern printed in the non-overlap regions can be used to measure the distance between dies in the print head axis direction and this distance can be used to determine correction values in the print head axis direction but also to provide a best reference for determining corrections in the direction perpendicular thereto.

In one example, the interferential-type pattern can comprise features printed in a row extending perpendicularly to the print head axis, wherein the features printed by two neighboring nozzle arrays in the same overlap region are offset by a predetermined amount relative to each other in the direction perpendicular to the print head axis when the nozzle arrays are in a nominal position. The associated reference pattern then may comprise a set of reference images, the reference images simulating the interferential-type pattern printed by the side sections of two neighboring nozzle arrays in the same overlap region for a number of different alignment states of the nozzle arrays.

In examples, the reference pattern may comprise at least one of: an image corresponding to the interferential-type pattern when printed by the side sections of neighboring nozzle arrays in the overlap region when the nozzle arrays are in a nominal position; an image corresponding to the interferential-type pattern when printed by the side sections of neighboring nozzle arrays in the overlap region when the nozzle arrays are misaligned by a positive amount in the direction perpendicular to the print head axis; and an image corresponding to the interferential-type pattern when printed by the side sections of neighboring nozzle arrays in the overlap region when the nozzle arrays are misaligned by a negative amount in the direction perpendicular to the print head axis. The reference pattern is not limited to three images or positions, but can be based on any number of images or positions corresponding to different alignment states.

The comparison of characteristics of printed the test pattern can be based on signal levels corresponding to color densities of the part of the pattern printed in the overlap region and of the reference images printed in the non-overlap region.

Based on the reference image printed in the non-overlap region, it may be possible to calculate a regression function of the signal level versus the simulated alignment state, and compare the signal level corresponding to the optical density of the part of the pattern printed in the overlap region against the regression function, thus obtaining a measure of the actual alignment. For calculating a regression function, at least two reference images or positions should be provided.

Additionally, a distance of reference images printed by two nozzle arrays in the respective non-overlap regions can be determined to derive information concerning the alignment of nozzle arrays in a print head axis direction.

In addition to the above, in examples, the reference pattern comprises a first set of reference images printed by a first nozzle array simulating a pattern printed by the side sections of two neighboring nozzle arrays in the overlap zone with no misalignment in the print head axis direction, and at least one second set of reference images printed by a second nozzle array simulating a pattern printed by the side sections of two neighboring nozzle arrays in the overlap zone with a predetermined misalignment in the print head axis direction.

When the reference pattern comprises several sets of reference images simulating different alignment states in the print head axis direction, it is possible to derive a first group of signal levels from the first set of reference images and a second group of signal levels from the second set of reference images, etc., to calculating a first regression function based on the first group of signal levels and a second regression function based on the second group of signal levels, etc.; and selecting one of the regression functions based on the derived information concerning the alignment of nozzle arrays in a print head axis direction. The selected regression function is used to compare the signal level corresponding to the optical density of the pattern printed in the overlap region of the first and second nozzle arrays against the selected regression function.

The present disclosure also provides a printer including a number of print heads extending across a print zone, each print head including at least one nozzle array extending in a direction of a print head axis, each nozzle array comprising a center section of nozzles and side sections of nozzles, wherein the side sections of adjacent nozzle arrays overlap defining an overlap region and the center sections of the nozzle arrays define non-overlap regions; a scanning device mounted on a carriage for scanning across a print medium; and a printer controller, the printer controller including a control program for driving the print heads to print a test pattern using at least two nozzle arrays, the test pattern comprising an interferential-type pattern printed by the side sections of two neighboring nozzle arrays in the overlap region and a reference pattern printed by the center sections of the nozzle arrays in the non-overlap region; driving the scanner to scan the printed test pattern; comparing with each other characteristics of the scanned test pattern in the overlap region and the non-overlap region; and deriving information concerning the alignment of nozzle arrays from the comparison.

Further examples are described below.

FIG. 1 schematically shows a page-wide array printer 1 as one example of an environment in which the process can be practiced. The printer 1 comprises a print head array 3 on which a print bar 5 is mounted. The print head array comprises at least one print bar or a plurality of print bars, such as for different colors, for example. At least one print bar extends across the width of a print zone and hence has substantially the same length as the complete print head array; see FIG. 2.

Ink is supplied to the print bar 5 from an ink tank 7. The printer 1 may comprise a print head array for each color or type of ink or other printing fluid to be printed, each ink having its own tank. However, for clarity, only one print head array is shown, including only one print bar 5.

The print bar comprises a number of nozzles (not shown in FIG. 1) which can be in the region of several hundred, several thousand, or more. An example of the structure of the nozzles is described with reference to FIG. 2.

The printer 1 further comprises a print media transport mechanism 9 which, in use, is to transport a print medium 11 to be printed upon through a print zone 13 below the print head array 3. The print media transport mechanism 9 is to transport the print medium through the print zone 13 in at least one direction.

The printer may further comprise a scanning device (not shown) which can be mounted on a scanner carriage (not shown). Such a scanning device may include an illumination source and a plurality of optical detectors that receive radiation from the illumination source which has been reflected from the print medium. The radiation from the illumination source may be visible light but also can be at or beyond either end of the visible light spectrum. If light is reflected by a white surface, the reflected light may have the same or almost the same spectrum as the illuminating light. When there is an image printed on the print medium, the ink of the image surface may absorb a portion of the incident light which causes the reflected light to have a different spectrum and light density (amplitude). Each optical sensor can generate an electrical signal that corresponds to the reflected light received by the detector. The electrical sensors from the optical detectors can be converted to digital signals by analog/digital converters and provided as digital image data to an image processor.

A printer controller 14, such as a microprocessor, for example, is operative to control firing of the nozzles and the movement of the print media through the print zone 13. The printer controller 14 may include an image processor. The printer controller may also control the supply of ink to the print bar 5 from the ink tank 7. Instead of one controller, separate controllers could be installed for the print media transport mechanism 9, the print bar 5, and the ink supply from the tank 7. The controller has access to a memory 16. Images or jobs for the printer to print can be stored in the memory 16 until they are printed onto the print media by the printer. The printer controller 14 may store and run program modules for implementing the process according to examples as described herein.

Figure 2:
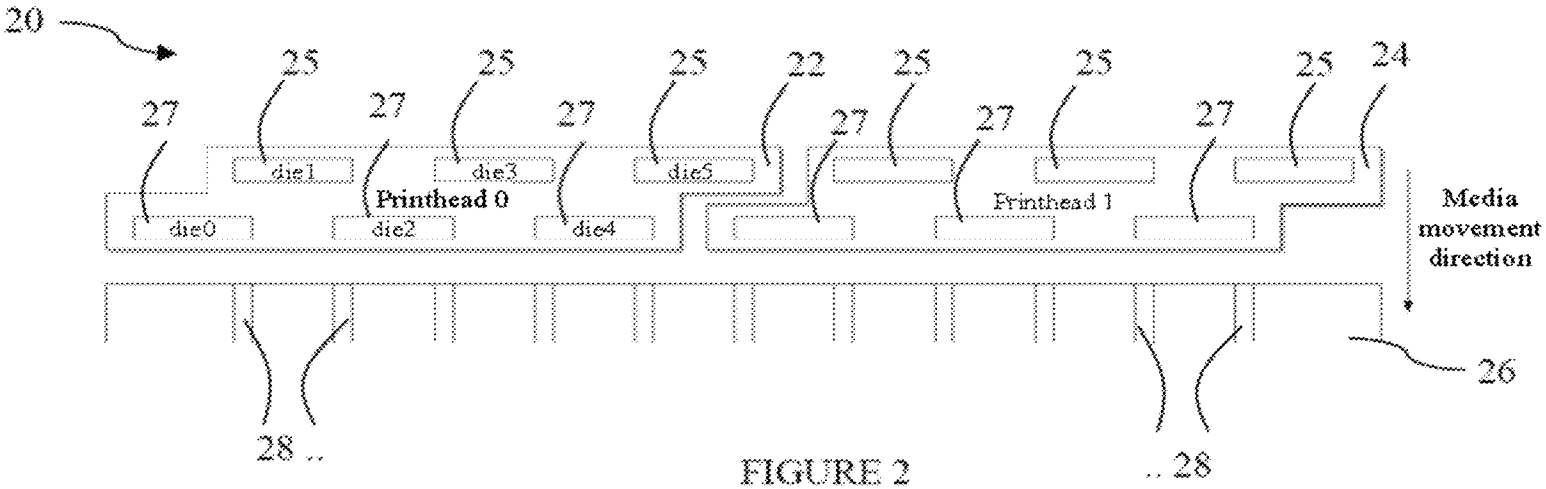
FIG. 2 shows a schematic drawing illustrating a print bar comprising two print heads in a page-wide array printer according to one example.

FIG. 2 schematically shows a print head architecture which can be used in the page-wide array printer of FIG. 1 and illustrates how die overlap may appear along a print out. The page-wide array printer comprises bars 20 of print heads 22, 24 which extends over the whole width of a print medium 26; thus, a whole page of the print medium can be printed with just one continuous media movement, orthogonal to the axis of the print heads 22, 24. Each print head comprises a number of dies 25, 27, each die 25, 27 providing an array of nozzles. Respective adjacent dies 25, 27 and their corresponding nozzle arrays overlap to a certain extent, wherein the overlap zones 28 are schematically indicated as respective stripes or zones on the print medium 26.

A page-wide array printer may have a superior printing speed but may need particular care to hide repetitive defects caused by the variability of the printer itself and the fact that there may be a single pass for all required printer qualities.

Figure 3:
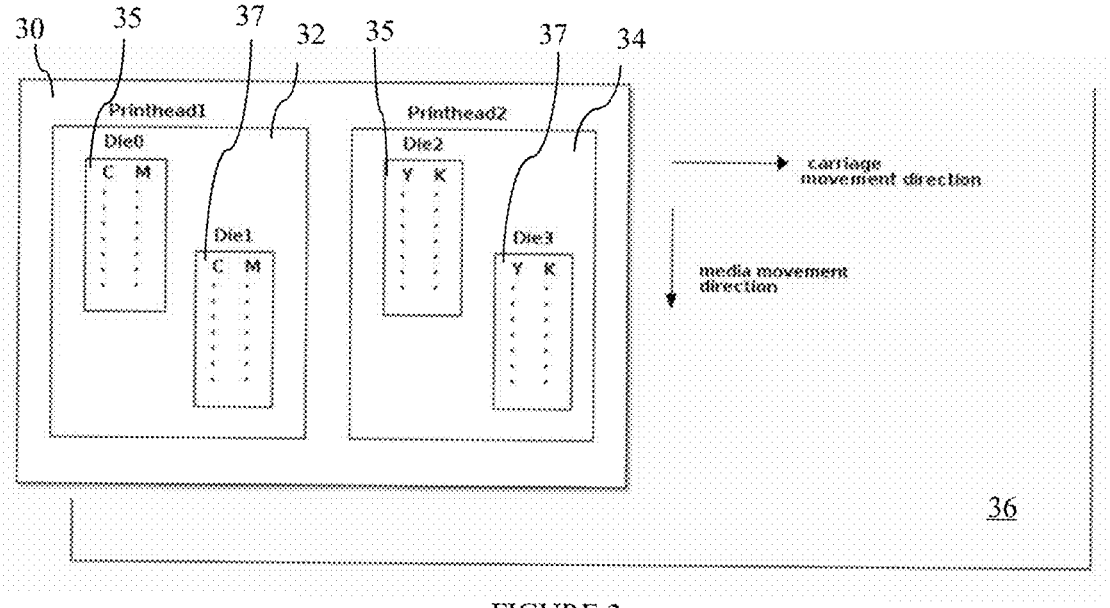
FIG. 3 shows a schematic drawing illustrating two print heads in a scanning printer according to one example.

A similar effect may occur in a scanning printer, when printing in a single-pass or low-pass mode. FIG. 3 shows a schematic example of the carriage architecture of one example of a scanning printer which also can implement the process according to examples as described herein. In this example, a carriage 30 carries two print heads 32, 34, each print head comprising a number of dies 35, 37, each die providing a nozzle array. A print media 36 is shown schematically, the print media moving in a media movement direction, parallel to the axis of the print head dies 35, 37, and the carriage 30 moves orthogonally thereto, in the carriage movement direction. In a scanning printer, the print head dies 35, 37 may be staggered with an overlap zone between them. In the example shown, print head dies 35, 37 of print head 32 provide two colors, cyan (C) and magenta (M), and there is some nozzle redundancy in the overlap zone of the two print head dies for these colors. The same configuration can be found in print head 34 for the colors yellow (Y) and black (K). This nozzle redundancy may be useful in one-pass or low-pass print modes to compensate for alignment defects between the two print head dies.

Figure 4:
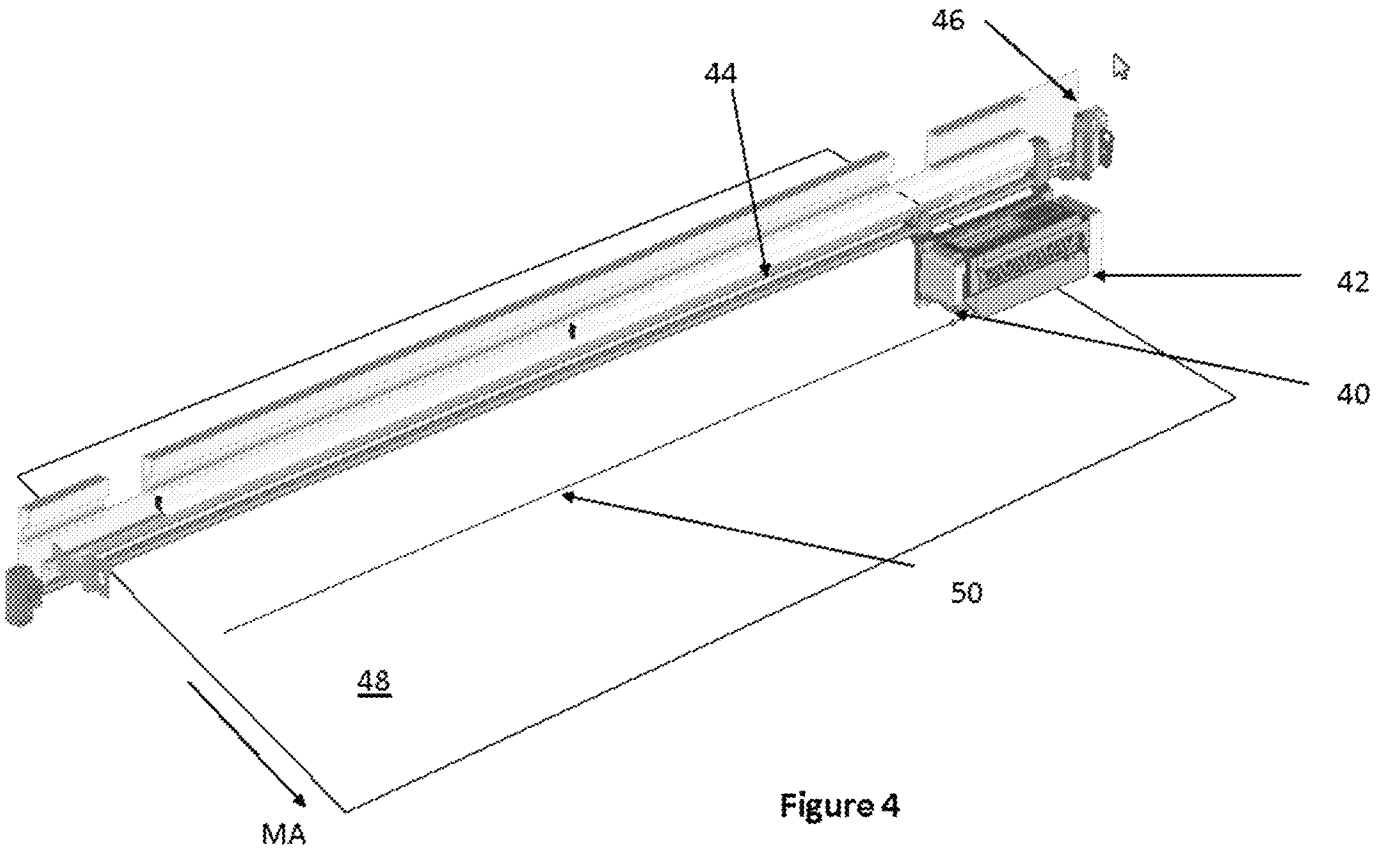
FIG. 4 shows an example of a scanning device.

FIG. 4 shows one example of a scanning system which can be used in the printer described above or in another type of printer. The scanning system comprises a scanner sensor 40 which is carried by a scanner and service carriage 42 along a guide rod 44. Movement of the scanner and service carriage 42 is driven by an impelling system 46, including an electric motor. FIG. 4 additionally shows a print medium 48 which is crossed by the scanner sensor 40 carried by the carriage 42. A media advance direction is indicated by arrow MA. Line 50 indicates a scanner spot trajectory generated when the scanner sensor 40 traverses the print medium 48.

When a scanning printer is used, a scanning device (not shown) for detecting characteristics of the printed image can be mounted to the print head carriage 30.

While the present disclosure can be used for both page-wide array printers and scanning printers, the following examples will refer mostly to page-wide array printers.

As explained, page-wide array printers usually print an image on a print medium in one pass. When printing an image in one pass, increased grain may be caused by a disturbed distribution between the drops printed by two adjacent dies in the overlap zone wherein the spread of distances between drops may be affected. Further, line banding may occur at the boundaries of the overlap zone, or more generally, when there is a sudden jump in droplet density within the same die. Last but not least, the main cause of tone shift banding is that the change in tone when drops of ink are superimposed is not linear in perception. In the example of FIG. 2, a page-wide array including twelve print head dies 25, 27 is shown, which gives a total of eleven zones of overlap where the image quality could be affected. More or less print heads and print head dies can be used.

As explained above, in the overlap zones, there is nozzle redundancy; this means that to print a pixel a printer can choose between two nozzles from two adjacent dies to fire the resultant dot. In order to split the task between two dies, the printer uses masks, which sometimes are called "weaving masks". When alignment errors between neighboring nozzle arrays are known, this knowledge can be used to compensate for said alignment errors, e.g. by varying the masks applied to the dies.

Figure 5:
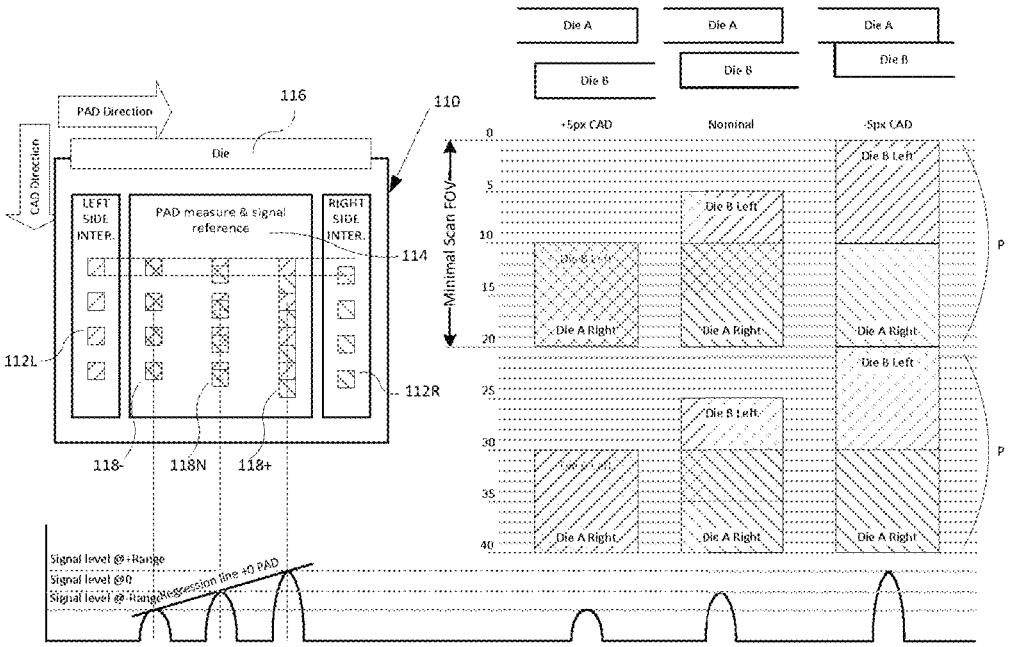
FIG. 5 shows an example of a test pattern printed by one nozzle array (3) and a resulting interferential pattern printed by the side sections of two neighboring nozzle arrays (dies) with different alignment errors.

FIG. 5, on the left-hand side, shows one example of a test pattern 110, including an interferential-type pattern 112L, 112R and a reference pattern 114 printed by the nozzle array of one die 116 (in the following simply referred to as die). FIG. 5 also illustrates the direction of the print head axis or die axis as PAD direction (pen axis direction) and the direction perpendicular thereto as CAD direction (cross axis direction). The pattern illustrated on the left-hand side of FIG. 5 corresponds to a test pattern printed by a single die 116, wherein a middle section of the nozzles of the die 116 is used for printing the reference pattern 114 and side sections of the nozzles of the die 116 are used to print the interferential-type patterns 112L, 112R. In a print head configuration having overlapping dies 116, the interferential-type patterns 112L, 112R will be printed in the overlap region, as described further below.

In the example of FIG. 5, the test pattern 110 is configured as follows. In the left overlap zone, corresponding to the left interferential-type pattern 112L, a group of blocks extending in the CAD direction is printed, the height of the blocks equaling a total expected CAD alignment error range. The distance in CAD direction between the blocks equals their height, i.e. the expected CAD alignment error range. In the right overlap zone, corresponding to the right side interferential-type pattern 112R, a similar block pattern is printed, but the blocks are moved in the CAD direction by half the expected CAD alignment error range, or half the height of a block. Accordingly, if the dies are in a nominal position, in the CAD direction, the side sections of neighboring dies 116, in the overlap zone, will generate a printed image as illustrated on the right-hand side of FIG. 5, at "Nominal", i.e. an interferential image corresponding to the case where there is no alignment error in the CAD direction (also referred to as CAD error) between two neighboring dies. This "nominal" image comprises elongated patches P having a length corresponding to the length of one block and one space of the interferential patterns 112L, 112R wherein one quarter of each patch is left blank, one quarter is printed only by the left side nozzles (printing the left-side interferential-type pattern 112L) of the right-hand die B; one quarter is printed by the left-side nozzles of the right-hand die B and the right-side nozzles (printing the right-side interferential pattern 112R) of the left-hand die A; and one quarter is printed only by the right-side nozzles of the left-hand die A. In the present example, with the interferential-type pattern comprising four spaced blocks, four elongated patches having the sequence of a quarter printed with only the right-hand die, a quarter printed with both dies, a quarter printed with only the left-hand die and a quarter left blank will be generated when there is no alignment error in the CAD direction (also referred to as CAD error). It should be observed that the enlarged view at the right-hand side of FIG. 5 shows only two of these patches.

On the right-hand side of FIG. 5, two additional images are shown including resulting patches which are printed when two neighboring dies are misaligned in the CAD direction by half a block height in either one of the +CAD direction and the −CAD direction. The patches P depicted under "+5px CAD" represent the case that the right-hand die B is shifted relative to the left-hand die A by half a pixel height in the +CAD direction so that the resulting patches P are composed by one half left blank and the other half printed with both dies A and B. The patches P shown under "−5px CAD" will be generated for a case that the die B on the right-hand side is shifted relative to the die A on the left-hand side by half a block height in the −CAD direction. The resulting image is shown on the right-hand side of FIG. 5, under "−5px CAD", as being composed of patches P where one half is printed by the right-hand die B and the other half is printed by the left-hand die A. It will be understood that this particular pattern is just an example.

The center region 114 of the test pattern 110 may be composed of a number of images which correspond to images printed in the overlap region by adjacent dies at different alignment states. In the example shown in FIG. 5, the reference pattern 114, printed in the central part, comprises three images 118N, 118− and 118+, simulating patterns printed in the overlap zone when there is no alignment error in the CAD direction (118N), when there is an alignment error in the negative CAD direction (118−); and when there is an alignment error in the positive CAD direction (118+), corresponding to the overlapping conditions illustrated on the right-hand side of FIG. 5.

It should be noted that the example of the test pattern and the resulting printed images shown in FIG. 5 assumes a case that there is no alignment error of the dies in the print head axis direction (PAD direction). Alignment errors in the PAD direction can be taken into account by modifying the reference pattern, as explained further below.

At the bottom of FIG. 5, a diagram illustrates that the different parts of the test pattern 110, including the images 118N, 118–, and 118+, will produce different output signals when scanning these images. These output signals can be derived from a defined optical parameter of the images printed based on the test pattern. The optical parameter may be related, for example, to an optical density of the image, the lightness or optical density of the image, spectral distribution of the image, or any other suitable optical parameter which will vary when the interferential pattern is printed at different alignment states of the dies. In the example described, the scanning device and image processor derive signals, the level of which corresponds to the optical density of a scanned image. In this example, the image 118–, simulating to a –CAD error, generates the lowest signal level and the image 118+, simulating to the +CAD error, generates the highest signal level, with a medium signal level derived from the part of the reference pattern simulating to the nominal position of the dies, 118N. As also shown in right hand side of FIG. 5, the signal levels from scanning the actual interferential type patterns printed by two adjacent dies in the overlap zone at different CAD alignment states, match the reference signals obtained by scanning the center portion of the die, including the three reference images 118N, 118– and 118+.

This relationship can be used for determining alignment errors between neighboring dies.

Figure 6:
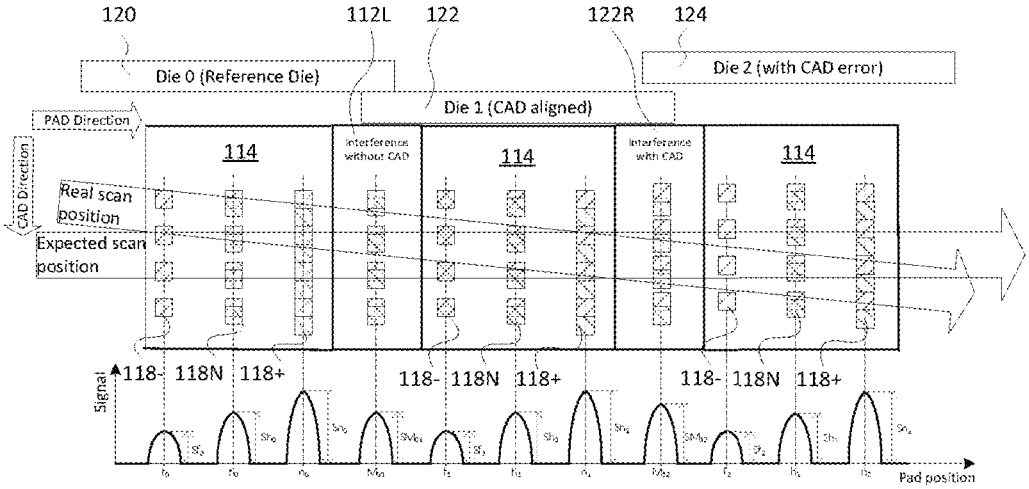
FIG. 6 illustrates images of test patterns printed by neighboring nozzle arrays (dies) having no/different alignment errors.

FIG. 6 schematically illustrates how a test pattern printed from three adjacent dies 120, 122, 124 can be scanned and processed, according to one example. Die 120 may be considered to be a reference die; die 122 may be considered to be aligned with reference die 120 in the CAD direction; and die 124 can be considered to be a die having an alignment error in the CAD direction, relative to neighboring die 122, in this example. Further, in the example of FIG. 6, it is assumed that there is no alignment error in the PAD direction.

The middle section of each of the dies 120, 122, 124 will print equal reference patterns in the respective non-overlap regions 114. The reference patterns may correspond to those described with reference to FIG. 5. In a first or left-hand overlap region 112L between reference die 120 and aligned die 122, a first resulting interferential image is printed by the respective side sections of dies 120 and 122. This image reflects an aligned state and hence corresponds to the "nominal" patches on the right-hand side of FIG. 5. In the second or right-hand side overlap zone 112R, the respective side sections of dies 122 and 124 print an interferential image which includes patches deviating from the nominal interferential image and hence indicates an alignment error in the CAD direction.

The images resulting from printed test patterns are detected by a scanning device which is moved across the printout in the PAD direction, e.g. by moving scanning sensors across a print medium on a dedicated scanner carriage. FIG. 6 illustrates that the scanning position and direction usually would be expected to extend in the PAD direction, perpendicular to the longitudinal axis of the reference images. However, due to mechanical tolerances of a carriage carrying the scanning device, the real scanning position and direction may well deviate from the expected scanning position and direction in that the scanning trajectory extends obliquely to the PAD direction. Depending on the mechanical tolerances of the carriage carrying the scanning device, this deviation may be in the range of e.g. ±5 mm or ±10 mm or the like, depending on the size of the print bar. The reference pattern of this disclosure, to a large degree, is insensitive against these mechanical tolerances of the scanning device and its carriage and allows to derive alignment errors of the print head dies 120, 122, 124 even when a scanning device is used which is not carried by a precisely mechanized carriage. Whether the scanning device moves along the expected scan position or along a trajectory deviating therefrom at some angle, the signals derived by the scanning device will still output the correct value of a defined parameter, such as the optical density, of the images generated by the reference pattern and the interferential-type pattern. Accordingly, precise alignment errors can be derived even when the scanning device does not travel along a well-defined scanning trajectory because the test pattern is insensitive against tolerances of this scanning device. One limitation of the allowed deviation of the trajectory of the scanning device from the expected scan position is that the scanning device always should cross some part of each image of the test pattern, the images corresponding either to a simulated alignment state represented in the nonoverlap zone 114 or a interferential image printed in one of the overlap zones 112L, 112R. Further, the test pattern should be adapted to the field of view of the scanning device such that the scanning device, crossing the individual images of the test pattern, scans an area corresponding to at least two times the block height, or one patch, in the present example, or some other area which is sufficiently wide, to be able to distinguish between optical parameters of different patches, such as the patches on the right-hand side of FIG. 5. For example, a pattern having a maximum range of FOV/2 would be suitable. For clarity, in FIG. 6, a scanning device having a narrower field of view depicted so as not to obscure the patches underneath the scanning device.

The scanning device hence detects the optical density or another optical parameter (in the following referred to as "optical density", without limiting this disclosure to only this particular optical parameter) of the various images 112L, 118–, 118N, 118+, and 112R derived from the test pattern. The detection result is converted into signal levels corresponding to the optical parameter. Examples of signal levels are shown at the bottom of FIG. 6 wherein the signals f0, h0, n0; f1, h1, n1; and f2, h2, n2 correspond to the optical density of the images of the reference patterns printed by the reference die 120, the aligned die 122, and the die 124 having an alignment error in the CAD direction. The signals f, h and n reflect the color densities of the images of the reference pattern corresponding to a nominal alignment state (h), a CAD error in the –CAD direction (f) and a CAD error in the +CAD direction (n). Signal $M_{01}$ is derived from the left-hand side interferential pattern 112L, reflecting a nominal alignment between reference die 120 and aligned die 122; and signal $M_{12}$ corresponds to the right-hand side interferential pattern 112R, reflecting an alignment error between aligned die 122 and die 124 in the –CAD direction.

Figure 7:
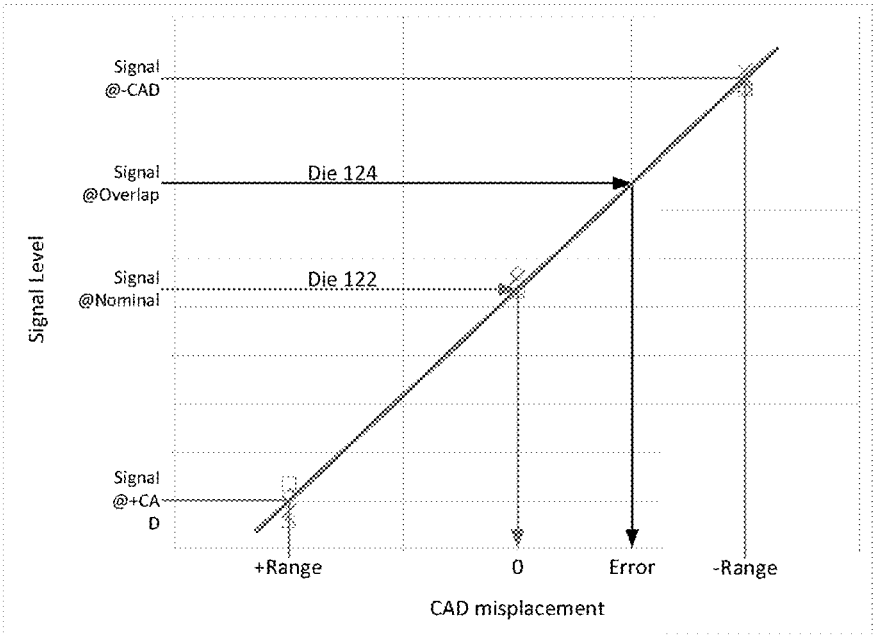
FIG. 7 shows a diagram of a linear regression function derived from a reference pattern.

FIG. 7 shows one example how the output signals of the scanning device can be processed for determining the alignment states of the dies 122, 124 relative to die 120. The signal levels derived from the reference patterns 114 (signal peak heights: Sf, Sh, Sn in FIG. 6) can be used for calculating a regression function, such as the linear regression line shown in FIG. 7. In this example, there are three measurements for each reference pattern 114, each of the patterns generating a signal value for a nominal alignment state (0), a maximum alignment error in the –CAD direction (–

Range) and a maximum alignment error in the +CAD direction (+ Range). These signal levels can be used for deriving a reference function which, in this example, is based on a linear regression. Once this reference function is computed, the signal level acquired from the images in the overlap regions 112L and 112R (SM01 and SM12 in FIG. 6) can be compared against the regression function to derive a resulting alignment error between the reference die 120 and a die 124, as shown in FIG. 7 at "error". As can be seen, the resulting alignment error for die 122 is zero (0) and the resulting alignment error for die 124 is about ½ of the maximum deviation, in this case about ¼ block height.

To increase robustness, it is possible to perform more than one measurement for each reference pattern 114 and each image 118–, 118N, 118+ of the reference pattern. As there usually is a number of dies in a page-wide array printer, and each die can be used for printing a reference pattern, robustness of the reference signals can be very good. For the sake of simplicity, in the example of FIG. 7, a linear interpolation is calculated from only three different reference images per reference pattern, printed by three different dies. However, it is possible to use more reference images or different reference images for each die and it also is possible to use a different type of regression function, such as a second degree polynomial interpolation or even some more complex function instead of a linear interpolation because the signal level derived from the reference pattern does not necessarily have a linear relationship to the optical density or some other optical parameter of the printed test pattern. In fact, robustness can be increased by using different reference images for each die as if the overlap-to-signal function has a complex shape and hence using more complex interpolation functions for imaging the relationship between signal level and alignment error. Further details are explained below.

While the present examples are based on detecting the optical density of the individual patches of the test pattern, deriving signal levels therefrom and comparing signal levels generated from the interferential-type patterns with signal levels generated from the reference pattern, it is also possible to consider another parameters of the test pattern, such as reflectivity, color, or brightness, or to perform a different type of processing. Image processing can be fully digital.

The concept presented above can be extended to a case where there is an alignment error in the print head axis direction (PAD) different from zero. A PAD error can be determined by using the images 118–, 118N, 118+ of the reference patterns 114 of adjacent dies for computing the distances between said dies. Based on determined distances between the dies, which may correspond to a nominal distance or may deviate therefrom, the reference pattern 114 can be modified to simulate also alignment states which include, in addition to a CAD error, also a PAD error. This can help to increase robustness of the determination of the alignment of dies in the CAD direction.

Figure 8:
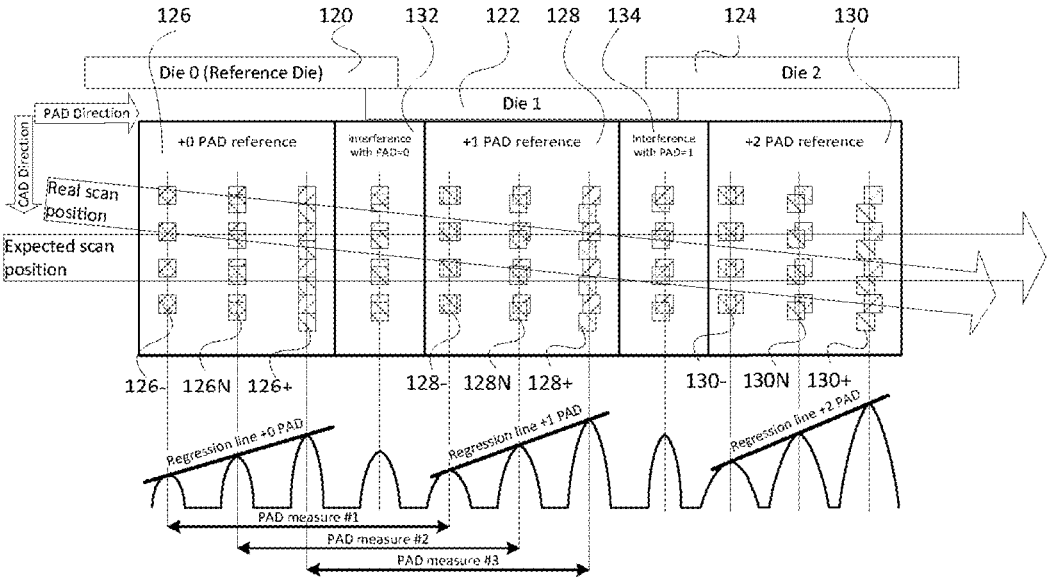
FIG. 8 shows a similar representation as FIG. 6, additionally taking into account an alignment error in the print head axis direction.

FIG. 8 illustrates one example how alignment errors both in the CAD direction and the PAD direction can be determined using a test pattern which is modified when compared to the pattern described with respect to FIGS. 4 and 5.

In the example of FIG. 8, again three dies 120, 122 and 124 are used for printing the test pattern. The central part of each of the three dies prints one of three reference patterns 126, 128, 130 which are based on reference pattern 114, illustrated in FIGS. 4 and 5, but which are modified as follows: Reference pattern 126 includes three images 126–, 126N and 126+ which fully correspond to the reference images 118–, 118N and 118+ of FIGS. 4 and 5, and which simulate three different alignment errors in the CAD direction (CAD errors of +½ box height, 0, and −½ box height) and an alignment error in the PAD direction (PAD error) of zero. Reference pattern 128 comprises three images 128–, 28N, and 128+ which correspond to the images 126–, 126N, and 126+, simulating the three different CAD errors, but which additionally simulate an alignment error in the PAD direction (PAD error). This simulation assumes an interferential pattern which would be generated in the overlap zone when one die is offset relative to its neighboring in the PAD direction by a certain amount (in this example by ¼ block width). The third die 124 generates a third reference pattern 130 which basically corresponds to the reference pattern 128 but wherein the images 1309–, 130N, and 130+ simulate a PAD error which is twice as big as the PAD error simulated by reference pattern 128 (in this case ½ block width). In summary, the three dies 120, 122, 124 hence provide a total of nine reference images which simulate alignment errors between adjacent dies ranging from a zero PAD error and a zero CAD error (patch 126N) to a maximum PAD error (reference pattern 130) and a maximum CAD error (any of patches 126–, 126+; 128–, 28+; 130–, 130+).

As in the example described before, the printed test patterns will be scanned by a scanning device which may travel along an expected scanning trajectory or along a trajectory deviating therefrom, as indicated in FIG. 8 by "expected scan position" and "real scan position". In this regard, reference is made to the description of FIG. 6.

From scanning the printed test pattern, signal levels corresponding to an optical parameter of the various images or patches of the test pattern can be derived, as shown at the bottom of FIG. 8. These signals can be used to measure the distances between dies in the PAD direction, by measuring the distances of corresponding signal peaks, and further to compute a number of regression functions which can be used to more precisely determine the alignment errors in the CAD direction.

As shown in the example of FIG. 8, the distance of neighboring dies can be determined by taking into account not only the distance of a single pair of two corresponding reference images, such as images 126– and 128–, but by evaluating the distances between each of the pairs of corresponding images so as to increase the robustness of the distance measurement. In this example, the peaks at the center of each signal are used to compute the distances between dies and to evaluate whether two adjacent dies are at a nominal distance in the PAD direction (PAD error=0) or are offset relative thereto (PAD error≠0). In FIG. 8, three distance measurements, PAD measure #1, #2, and #3, are illustrated. Further, each set of signal levels corresponding to one reference pattern 126, 128, 130, generated by the individual dies, can be used to derive a separate regression function, such as the linear regression functions designated as "Regression line +0PAD", "Regression line +1PAD", and "Regression line +2PAD" in the diagram at the bottom of FIG. 8. Each of these regression functions is associated with a defined PAD error which is simulated by the respective reference pattern. As the PAD error between the dies 120, 122, 124 now is known, the signal levels derived from the interferential-type patterns printed in the overlap regions 132, 134 can be compared against that regression function which corresponds to the PAD error determined for the respective pair of dies.

In the present example, the reference patterns 128 and 130, simulating different CAD errors, reflect alignment errors in the same direction (such as +¼ block width and +½ block width). The effect of PAD alignment errors in the generated signals are the same for positive and negative PAD errors. This is at least true when the test pattern is generated from a row of boxes as in the present example. For a different type of test patterns, it might be advisable to provide positive and negative PAD error references, as needed.

Figure 9:
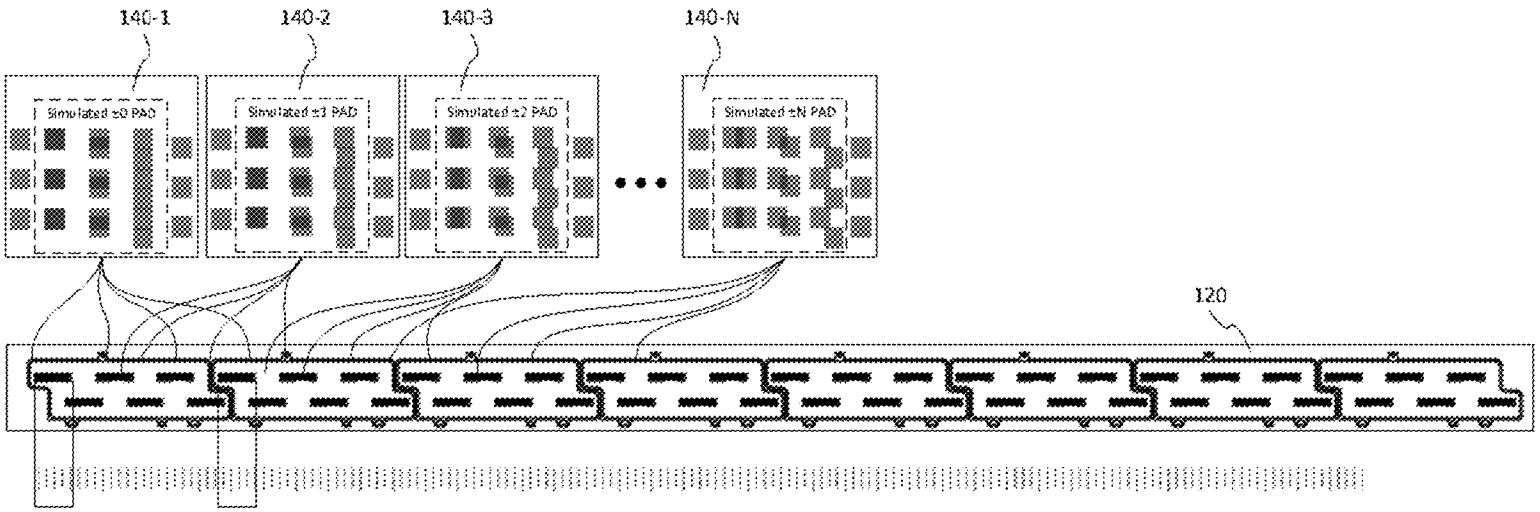
FIG. 9 shows another example of a number of test patterns printed by a number of dies of a print bar.

FIG. 9 is an illustration of a number of test patterns 140-1, 140-2, 140-3, . . . 140-N which are printed by respective dies of a number of print heads of a print bar 120 of a page-wide array printer. In the example of FIG. 9, each print head comprises six dies wherein each die can be used to print one of the test patterns 140-1, 140-2, 140-3, . . . 140-N. As also illustrated in FIG. 9, different dies can be used for printing different reference patterns, simulating different PAD errors, such as a zero PAD error in test pattern 140-1, a +/−1 PAD error in test pattern 140-2, a +/−2 PAD error in test pattern 140-3 etc. These test patterns generally correspond to the test patterns 126, 128, 130 described with reference to FIG. 8. FIG. 9 also illustrates that additional alignment states can be simulated by the test pattern, such as a more severe alignment error simulated by test pattern 140-N. The interferential-type pattern at the two sides of the test pattern is the same, in this example.

Figure 10:
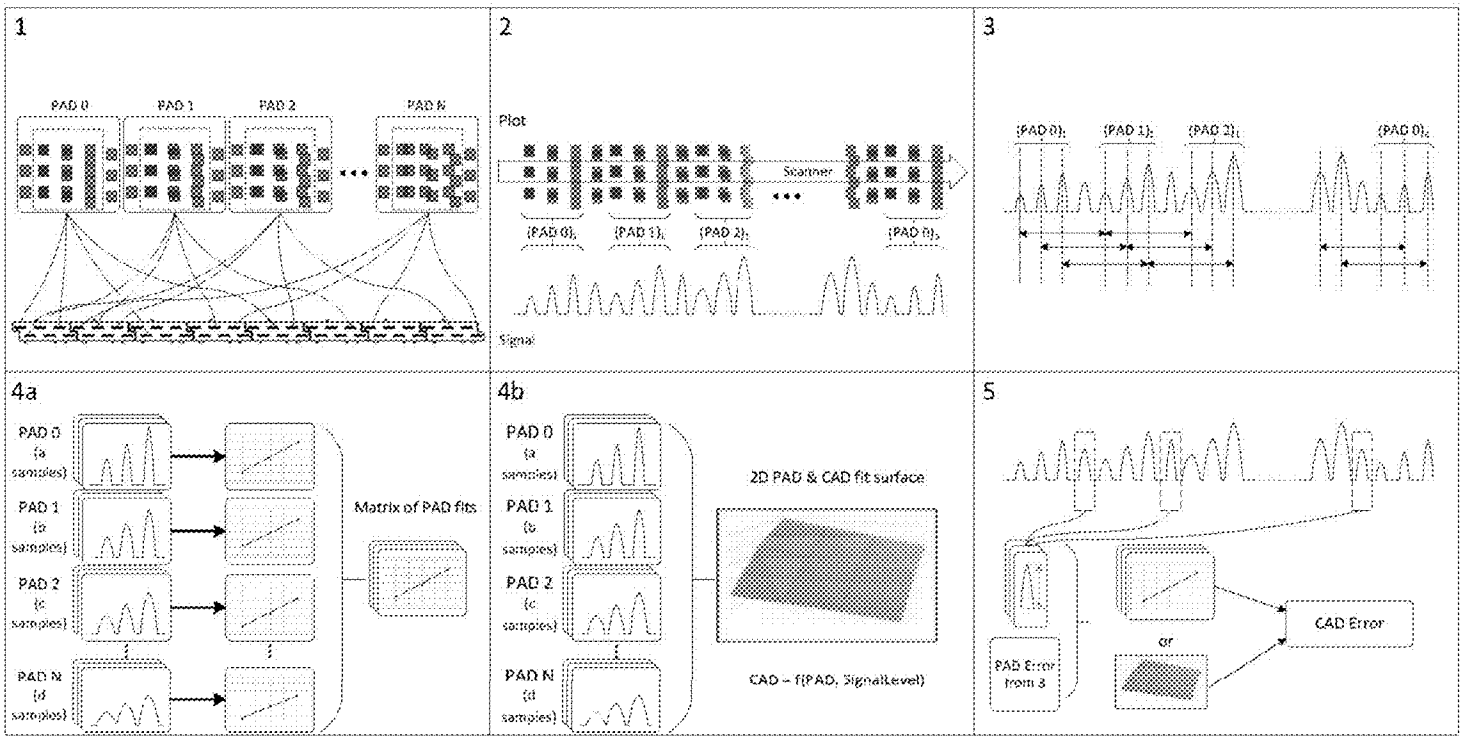
FIG. 10 shows a sequence of a process according to one example of this disclosure.

FIG. 10 provides an overview for illustrating one example of a process of determining alignment errors between dies, based on the principles illustrated above. The determined alignment errors then can be used to control a printing process to compensate for any alignment errors determined.

At block number 1, test patterns are printed, each test pattern including interferential-type patterns at the side portions thereof and a reference pattern in the middle portion. Each refer pattern within a single die simulates three alignment states in the CAD direction, where—in the reference patterns further simulate different alignment states in the PAD direction, each die a different PAD error, designated as PAD 0, PAD 1, PAD 2, . . . PAD N in block number 1. These test patterns correspond to the ones illustrated in FIGS. 7 and 8 and described above.

Each of the dies or a selected number of the dies of the print bar prints one of the test patterns and the printed image or plot is scanned, as illustrated in block number 2. The scanner does not need to move exactly along a defined trajectory but it is sufficient that the field of view crosses each of the printed images so as to capture at least one patch of each image, as illustrated above. The output signal of the scanning device can be processed in an image processor to derive signals or values corresponding to some optical parameter of the scanned images, such as the optical density. In the example of FIG. 5, the illustrated signal represents the optical density of each of the scanned images, including three reference images printed from each test pattern and one interferential image printed in the overlap region of two dies, overlapping the respective interferential-type pattern. As explained above, the test pattern is insensitive against alignment errors of the scanning device. Further, while the signals derived from the test pattern are shown in analog form in block 2, any other representations of an optical characteristic of the printed images, including a fully digital representation, can be used.

From the location of the signal peaks, the distance between the individual dies of the print bar can be calculated to verify the relative alignment of the dies in the PAD direction. Any deviation from a defined distance can be recognized as a PAD error; see block 3.

For determining the CAD error, as explained above, the signal levels derived from the reference patterns can be used for calculating a regression function. One approach, shown in block 4*a*, is to use a one-dimensional fitting which can be a 1-degree polynomial, or a 2- or more-degrees polynomial or some other mathematical fitting, for each of the PAD error cases so that one function for the CAD error, CAD=f (SignalLevel) is provided per PAD error, as shown in block 4*a*. Eventually, there can be a set of 1D fitting functions, one for each PAD error, which could be combined to a matrix of PAD fits. Alternatively, it is also possible to do a two-dimensional fitting by providing a function of the CAD error which depends on the signal height and the PAD error, such as CAD=f (PAD, SignalLevel). In this case, a multi-variable fitting could be used, such as some Bicubic, Bilinear, Bezier fitting or the like. This is illustrated in block 4*b*. In this second case, the result is a function which can directly yield a CAD error from given coordinates [PAD, SignalLevel]. This is schematically illustrated in block 4*b* as a curved surface. "SignalLevel" represents a value derived from the optical parameter detected by the scanner.

When using the approach illustrated in block 4*a*, if the determined PAD error between two dies is in-between two of the PAD references, it is advisable to use an interpolation between the resulting CAD errors derived from the reference patterns corresponding to the two closest PAD errors. For example, if a measured PAD error between two dies is 1.5, the signals derived from the interferential-type pattern should be compared against an interpolated function between the two CAD fittings of PAD 1 and PAD 2. Other approaches can be used, such as using the CAD fitting of the nearest die with a PAD value closest to the measured one, or some other criteria. When using the two-dimensional approach of box 4*b*, the respective "interpolated" values may be directly derived from the two-dimensional fitting CAD=f (PAD, SignalLevel).

Box 5 illustrates how the signals derived from the interferential-type patterns (surrounded by dashed lines), in combination with the PAD error derived in box 3, can be used to compute the CAD error. In case of the one-dimensional fitting, the appropriate regression function is selected based on the PAD error determined in block 3. Using the two-dimensional approach, the PAD error and the signal level can be input directly to the fitting function in order to determine the CAD error. The regression or fitting functions can be based on a linear regression or some higher order polynomial which also will depend on the relationship between the optical parameter detected and the influence of PAD errors and CAD errors on the signal level.

Above, one type of test pattern, including a reference pattern and an interferential-type pattern has been described, by way of examples. There are other patterns which follow the same principles and may be used. For example, the reference pattern can be designed as continuous patches, instead of groups of small blocks, having an expected ink density to precisely measure the expected signal peak for a particular alignment state. It is also possible to provide a big block having a gradient of ink density, similar to what has been shown by the respective three patched images of the reference pattern but in a continuous form instead by providing discrete block-stepped patterns. Further, instead of using a number of boxes, either for the reference pattern or for the interferential-type pattern, it is also possible to use a dot-shaped or any other shaped interferential pattern; it is possible to vary the ink density within one continuous box or a differently shaped patch; it is possible to provide a set of interleaved teeth with columns on the side, similar to two interleaved combs or a zipper; it is possible to provide an interleaved wedge-shaped pattern or any other suitable shape for the interferential-type pattern, to be printed in the overlap region, and for the reference pattern simulating different alignment states of the dies and resulting images printed in the overlap region.

Figure 11:
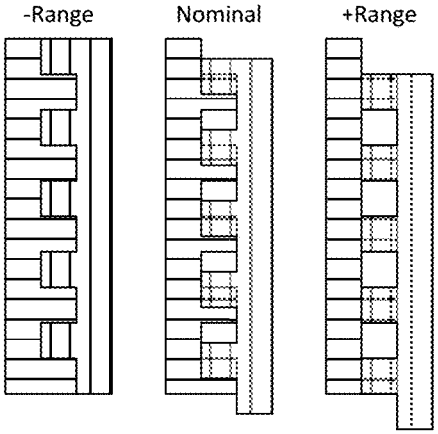
FIGS. 11 to 13 show schematic drawings of alternative test patterns according to further examples.
Figure 12:
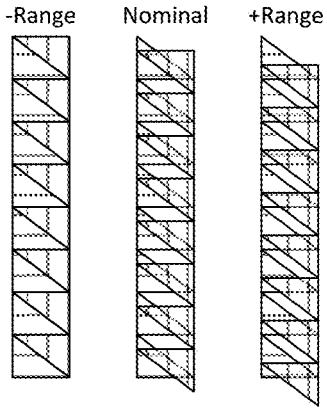
Figure 13:
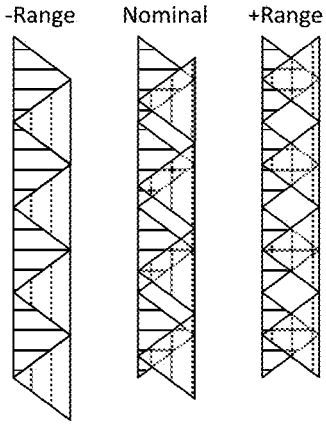

FIGS. 11 to 14 show alternative examples of test patterns which can be used in the same or a similar way as the test patterns described above. In FIGS. 11 to 13, only the respective reference patterns are shown, simulating three different alignment states of two overlapping dies printing the interference pattern in the overlap region.

FIG. 11 shows an example of an interleaved pattern where the side nozzles of two adjacent dies, in the overlap region, would each print a respective comb-shaped pattern where the patterns complement each other and are interleaved or interdigitated. In FIG. 11, the pattern printed by one of the dies is hatched in the horizontal direction and the other pattern is hatched in the vertical direction. The respective hatchings represent the different colors printed by the adjacent dies. The interferential-type patterns, at the right-hand side and at the left-hand side of the reference pattern, will be offset relative to each other in the CAD direction, as explained above with respect to FIGS. 5 to 8. In case of FIG. 11, the offset can be ½ of the height of one of the "teeth" of the "comb". Accordingly, when the interferential-type patterns are printed in the overlap region, depending on the alignment state of two overlapping dies, different interferential images will result, the reference pattern simulating these different alignment states.

As shown in FIG. 11, in this example, the comb-shaped patterns would fully complement each other if there is a −CAD offset of ½ height of a "tooth". The "teeth" of the comb will partially overlap when there is no CAD error, and the "teeth" of the comb will fully overlap when there is a +CAD error of ½ height of a "tooth".

FIGS. 12 and 13 show two other examples of interleaved or interdigitated test patterns where opposite rows of triangles are printed by the respective side nozzles of overlapping dies in the overlap zone wherein, depending on the alignment state, the triangles will complement each other or overlap.

Figure 14:
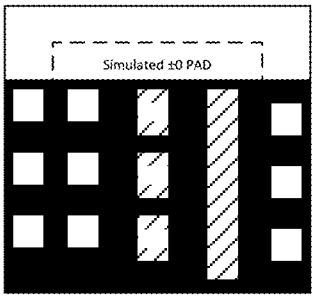
FIG. 14 shows an example of yet another test pattern which is an inverted version of the test pattern shown in FIG. 5.

In another example, shown in FIG. 14, an inverted or "negative" version of the reference pattern of FIG. 5 is used wherein the interferential-type pattern is composed of white boxes on a black background, as shown on the left-hand side and right-hand side of FIG. 14. The respective reference pattern, simulating different CAD alignment states, may then comprise also white boxes for a +CAD error of ½ of a block height, or patches including the sequence of grey-white-grey-black when there is no CAD alignment error, or a fully grey patch for a −CAD error of ½ of a block height.

In each of the test patterns of FIGS. 11 to 14, the respective interferential-type patterns on the right-hand side and on the left-hand side of the test pattern are offset relative to each other in the CAD direction, as explained above with respect to the test pattern shown in FIG. 5.

Figure 15:
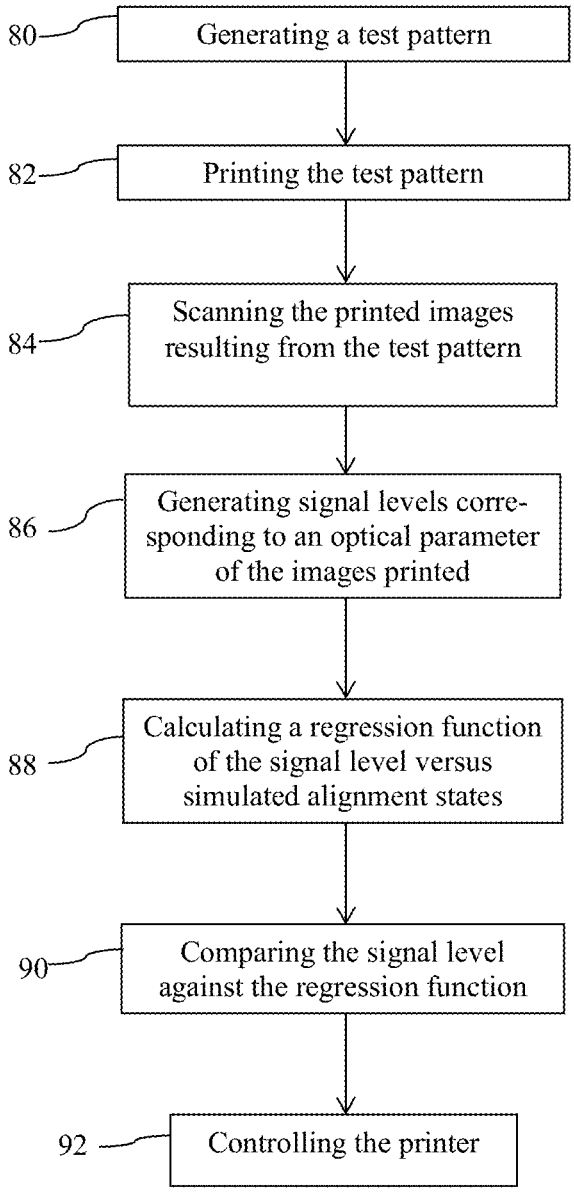
FIG. 15 shows a flow diagram of a method according to one example of controlling a printer.

FIG. 15 illustrates a flow diagram of one example of a method of controlling a printer using one of the above approaches. The printer includes a number of print heads extending across a print zone, each print head including at least one nozzle array extending in a direction of a print head axis, each nozzle array comprising a center section of nozzles and side sections of nozzles, wherein the side sections of two neighboring nozzle arrays overlap defining an overlap region and the center sections of the nozzle arrays define non-overlap regions. The method comprises: generating 80 a test pattern, the test pattern including an interferential-type pattern and a reference pattern, the reference pattern including reference images simulating alignment states; printing 82 the test pattern using at least two nozzle arrays, wherein the interferential-type pattern is printed by the side sections of two neighboring nozzle arrays in the overlap region and the reference pattern is printed by the center sections of the nozzle arrays in the non-overlap regions; scanning 84 the printed images resulting from the test pattern; generating 86 signal levels corresponding to an optical parameter of the interferential images printed in the overlap region and of the reference images printed in the non-overlap region; calculating 88 regression functions of the signal level versus the simulated alignment states based on the reference images printed in the non-overlap region; comparing 90 the signal level corresponding to the optical parameter of the pattern printed in the overlap region against one of the regression functions to derive information concerning the alignment of nozzle arrays from the comparison; and controlling 92 the printer to compensate for any alignment errors based on the derived information.

In another aspect, a method of controlling a printer can be provided, the printer including a number of print heads extending across a print zone, each print head including at least one nozzle array, wherein the method comprises: printing a reference pattern; and printing a test pattern, the test pattern comprising an interferential-type pattern printed by at least two nozzle arrays of said print heads in an overlap region. The reference pattern may comprise at least one of: an image simulating the interferential-type pattern when printed in the overlap region when the nozzle arrays are in a nominal position; and an image simulating the interferential-type pattern when printed in the overlap region when the nozzle arrays are misaligned relative to each other. The method may further comprise: scanning the printed images resulting from the test pattern; comparing with the reference pattern the printed image resulting from the test pattern; and deriving alignment information from the comparison. This further aspect can be used in a scanning printer, for example, wherein the reference image simulates different bidirectional alignment states. The interferential-type pattern can be printed in a bidirectional mode, with forward and backward printing in the same overlap region, for example. The printer image resulting from the interferential pattern then can be compared to the reference pattern. In another example, two parallel dies provided in one or two print heads of a scanning printer can be aligned based on a comparison of a reference image printed by one of both dies individually and an interferential image printed by the two dies in combination in an overlap region.

The method and the printer of this disclosure use an alignment pattern which can be evaluated by a scanning device in a single pass to determine alignment errors both in the PAD direction and in the CAD direction. While only one scan of the scanning device is sufficient to gather the data necessary for determining alignment errors in the PAD and CAD directions, a printer may also perform a number of scans for increasing robustness but this number can be low, such as 2 or 3 scans. Additional scans can be performed but the number of added scans can be kept to a minimum to check for "consistency" between results and avoid singularities (due to a die not performing adequately at the beginning or after some time firing) to increase robustness. The test pattern is very robust against media advance errors and movement, positioning and trajectory errors in the scanning device because a scanning device will derive the same or almost the same signal levels, whether it crosses the test pattern along an expected trajectory or along a trajectory deviating therefrom, as illustrated in FIGS. 5 and 7. The test pattern should cover a sufficiently large area, in the CAD direction, so it will still be in the field of view of the scanning device, assuming a largest deviation of the scanning trajectory.

The test pattern can be used to determine alignment errors between dies in a page-wide array printer or in a scanning printer. In a scanning printer, the test pattern can be for bidirectional alignment of the same or different dies or for alignment of two dies relative to each other. In a bidirectional printing mode, for example, instead of printing the interferential-type pattern by two adjacent dies in the overlap zone, the interferential-type pattern can be printed by the same or different dies in the forward and backward direction. The information about the alignment errors can be used for calibrating print head dies. The test pattern also can be used to perform a media advance calibration. For this case, the pattern can be printed in several media advance cycles and PAD and/or CAD alignment errors of the print medium can be determined just in the same manner as the alignment errors between adjacent dies. From the determined alignment errors, movement of the print medium can be determined and calibrated.

For determining a media advance error, the test pattern will be printed in at least two subsequent media advance cycles and printed images can be compared against reference images printed on the same or a different print medium.

By using the test pattern of this disclosure, the alignment of print head dies and preciseness of print media advance can be determined with low medium consumption, with a small number of scans and with low computational requirements while being extremely robust against mechanical tolerances of the scanning device. The time needed for detecting alignment errors and performing calibration hence also is low.

The invention claimed is:

1. A printer comprising:

neighboring nozzle arrays extending across a print zone, each nozzle array of the neighboring nozzle arrays extending along an axis and comprising a first section of nozzles and a second section of nozzles, wherein the second sections of the neighboring nozzle arrays overlap defining an overlap region and the first sections of the neighboring nozzle arrays define non-overlap regions: and a controller to:

cause printing of a test pattern using the neighboring nozzle arrays, the test pattern comprising a first pattern printed by the second sections of the neighboring nozzle arrays in the overlap region, and a reference pattern printed by a first section of the first sections of the neighboring nozzle arrays in a non-overlap region of the non-overlap regions;

receive detected characteristics of the printed test pattern;

compare the characteristics of the printed test pattern in the overlap region and in the non-overlap region; and derive alignment information based on the comparing.

2. The printer of claim 1, wherein the first pattern comprises a group of features printed in a row extending perpendicularly to the axis, wherein the features printed by the neighboring nozzle arrays in the overlap region are offset relative to each other in a direction perpendicular to the axis when the neighboring nozzle arrays are in a nominal position.

3. The printer of claim 2, wherein the reference pattern comprises a set of reference images, the reference images simulating features printed by the second sections of the neighboring nozzle arrays in the overlap region for a number of simulated alignment states of the neighboring nozzle arrays.

4. The printer of claim 3, wherein the controller is to further determine a distance of the reference images printed by the neighboring nozzle arrays in the non-overlap region to derive information concerning an alignment of the neighboring nozzle arrays along the axis.

5. The printer of claim 4, wherein the reference pattern printed by a first nozzle array of the neighboring nozzle arrays comprises a first reference image simulating a pattern printed by the second sections of the neighboring nozzle arrays in the overlap region with no misalignment in the print head axis direction; and the reference pattern printed by a second nozzle array of the neighboring nozzle arrays comprises a second reference image simulating a pattern printed by the second sections of the neighboring nozzle arrays in the overlap region with a predetermined misalignment along the axis.

6. The printer of claim 5, wherein the controller is to further:

derive a first group of signal levels from the first reference image and a second group of signal levels from the second reference image;

calculate a first regression function based on the first group of signal levels and a second regression function based on the second group of signal levels;

select one of the first and second regression functions based on information concerning an alignment of the neighboring nozzle arrays along the axis; and compare signal levels corresponding to an optical parameter of the first pattern printed in the overlap region against the selected regression function.

7. The printer of claim 1, wherein the reference pattern comprises at least one of:

an image corresponding to the first pattern when printed by the second sections of the neighboring nozzle arrays in the overlap region when the neighboring nozzle arrays are in a nominal position;

an image corresponding to the first pattern when printed by the second sections of the neighboring nozzle arrays in the overlap region when the neighboring nozzle arrays are misaligned in a first direction perpendicular to the axis; or an image corresponding to the first pattern when printed by the second sections of the neighboring nozzle arrays in the overlap region when the neighboring nozzle arrays are misaligned in a second direction perpendicular to the axis, wherein the second direction is opposite to the first direction.

8. The printer of claim 1, wherein the controller is to detect the characteristics of the printed test pattern by:

generating signal levels corresponding to an optical parameter of a part of the first pattern printed in the overlap region and of the reference pattern printed in the non-overlap region.

9. The printer of claim 8, wherein the comparing of the characteristics of the printed test pattern comprises:

calculating a regression function of the signal levels versus simulated alignment states based on the reference pattern printed in the non-overlap region; and comparing the signal levels corresponding to the optical parameter of the part of the first pattern printed in the overlap region against the regression function.

10. The printer of claim 1, wherein the first pattern comprises a group of spaced blocks printed in a row extending perpendicularly to the axis, wherein each block of the group of spaced blocks has a height in a direction perpendicular to the axis and which corresponds to an expected maximum misalignment of the neighboring nozzle arrays in the direction, and wherein the distance between the blocks equals the height of each of the blocks, and wherein the group of spaced blocks printed by the second sections of the neighboring nozzle arrays in the overlap region are offset by half a block height relative to one other in the direction perpendicular to the axis when the neighboring nozzle arrays are in a nominal position.

11. The printer of claim 1, wherein the first pattern comprises at least one of:

a group of spaced features printed in a row extending perpendicularly to the axis;

an elongated feature extending in the direction perpendicular to the axis and having a gradient of color densities along a length of the elongated feature; or an interleaved pattern structure.

12. The printer of claim 1, wherein the reference pattern comprises at least one of:

a feature having an expected color density; or a feature having a gradient of color densities.

13. The printer of claim 1, wherein the controller is to use the alignment information to calibrate the neighboring nozzle arrays.

14. A printer comprising:

a number of print heads extending across a print zone, each print head including a nozzle array extending in a direction of a print head axis, each nozzle array comprising a first section of nozzles and a second section of nozzles, wherein the second sections of neighboring nozzle arrays overlap defining an overlap region and the first sections of the neighboring nozzle arrays define non-overlap regions;

an optical detector; and a controller to:

drive the print heads to print a test pattern using the neighboring nozzle arrays, the test pattern comprising a first pattern printed by the second sections of the neighboring nozzle arrays in the overlap region and a reference pattern printed by a first section of the first sections of the neighboring nozzle arrays in a non-overlap region of the non-overlap regions, wherein the reference pattern includes reference images simulating alignment states;

receive characteristics of the printed test pattern captured by the optical detector;

compare the characteristics of the printed test pattern in the overlap region and the non-overlap region; and derive alignment information based on the comparing.

15. The printer of claim 14, wherein the number of print heads comprise a page-wide array print heads, wherein each print head comprises a number of nozzle arrays.

16. The printer of claim 14, wherein the controller is to use the alignment information to calibrate the number of print heads.

17. A method of controlling a printer, the printer including neighboring nozzle arrays extending across a print zone, the method comprising:

printing a reference pattern, wherein the reference pattern is printed in a non-overlap region by a portion of a nozzle array of the neighboring nozzle arrays;

printing a test pattern, the test pattern comprising a first pattern printed by the neighboring nozzle arrays in an overlap region where the neighboring nozzle arrays overlap;

scanning the printed test pattern and the reference pattern;

comparing characteristics of the printed test pattern with characteristics of the reference pattern; and deriving alignment information based on the comparing.

18. The method of claim 17, wherein the reference pattern comprises an image simulating the test pattern when printed in the overlap region when the neighboring nozzle arrays are in a nominal position.

19. The method of claim 17, wherein the reference pattern comprises an image simulating the test pattern when printed in the overlap region when the neighboring nozzle arrays are misaligned relative to each other.

* * * * *